US008876098B2

(12) United States Patent
Arendt et al.

(10) Patent No.: US 8,876,098 B2
(45) Date of Patent: Nov. 4, 2014

(54) STITCHING MACHINE FOR VARIABLE SIZE SHEETS

(75) Inventors: Holger Arendt, Grossrinderfeld (DE); Dirk Waldmann, Bad Mergentheim (DE); Marcel Weiss, Bad Mergentheim (DE); Franz Mezger, Lauda-Koenigshofen (DE)

(73) Assignee: Mueller Martini Holding AG, Hergiswil (CH)

( * ) Notice: Subject to any disclaimer, the term of this patent is extended or adjusted under 35 U.S.C. 154(b) by 295 days.

(21) Appl. No.: 13/403,187

(22) Filed: Feb. 23, 2012

(65) Prior Publication Data

US 2012/0219385 A1 Aug. 30, 2012

(30) Foreign Application Priority Data

Feb. 25, 2011 (CH) ..... 0332/11

(51) Int. Cl.
*B42B 2/02* (2006.01)
*B42C 19/08* (2006.01)
*B42C 19/04* (2006.01)

(52) U.S. Cl.
CPC . *B42C 19/04* (2013.01); *B42B 2/02* (2013.01); *B42C 19/08* (2013.01)
USPC ..... 270/52.18; 270/52.26; 270/52.29

(58) Field of Classification Search
CPC ..... B42B 2/02; B42B 9/04; B42C 1/12
USPC ..... 270/52.18, 52.26, 52.29
See application file for complete search history.

(56) References Cited

U.S. PATENT DOCUMENTS

| | | | | |
|---|---|---|---|---|
| 4,519,599 | A * | 5/1985 | Mayer | 270/52.18 |
| 6,270,068 | B1 * | 8/2001 | Cracknell | 270/52.26 |
| 6,899,325 | B2 * | 5/2005 | Steinert et al. | 270/52.18 |
| 7,451,969 | B2 * | 11/2008 | Bottcher et al. | 270/52.14 |
| 7,628,389 | B2 * | 12/2009 | Steinert et al. | 270/52.26 |
| 7,644,850 | B2 * | 1/2010 | Gerlach et al. | 227/155 |
| 7,862,021 | B2 * | 1/2011 | Desfosses | 270/52.16 |

(Continued)

FOREIGN PATENT DOCUMENTS

| | | |
|---|---|---|
| EP | 2070718 A2 | 6/2009 |
| WO | WO-94/21544 A1 | 9/1994 |

OTHER PUBLICATIONS

International Search Report of CH 3322011 Dated Jun. 16, 2011 With English Translation.

*Primary Examiner* — Patrick Mackey
(74) *Attorney, Agent, or Firm* — Venable LLP; Robert Kinberg; George L. Howarah

(57) ABSTRACT

A thread stitching machine to process signatures into book blocks includes a transport system for the signatures including a transport section on which the signatures are straddling for supply to a stitching station. The transport section includes an auxiliary saddle and a driven, continuously moving conveying chain to drive the auxiliary saddle. The conveying chain has spaced-apart, integrated pusher elements. A downstream installed stitching station includes a freely moving stitching saddle immediately following the auxiliary saddle. The stitching saddle includes a separate conveying device for the signatures, operated by a drive. A detection device is arranged at a transition between the auxiliary saddle and the stitching saddle to detect a position of the signature and a time which the signature passes by. The conveying chain is operated with a change in speed that depends on different sheet lengths following each other directly in a sequence of signatures.

11 Claims, 5 Drawing Sheets

(56) References Cited

U.S. PATENT DOCUMENTS

| | | | | |
|---|---|---|---|---|
| 7,900,901 | B2 * | 3/2011 | Abegglen | 270/52.16 |
| 7,942,400 | B2 * | 5/2011 | Demarco | 270/58.29 |
| 7,988,138 | B2 * | 8/2011 | Brunner et al. | 270/52.18 |
| 2002/0059979 | A1 | 5/2002 | Machon | |
| 2002/0101019 | A1 | 8/2002 | Boss | |
| 2003/0214092 | A1 * | 11/2003 | Horii et al. | 270/52.18 |
| 2005/0248076 | A1 * | 11/2005 | Bottcher et al. | 270/52.18 |
| 2013/0154177 | A1 * | 6/2013 | Fritsch et al. | 270/52.18 |

* cited by examiner

STITCHING MACHINE FOR VARIABLE SIZE SHEETS

CROSS-REFERENCE TO RELATED APPLICATION

This application claims the priority of Swiss Patent Application No. 00332/11, filed on Feb. 25, 2011, the subject matter of which is incorporated herein by reference.

BACKGROUND OF THE INVENTION

The present invention relates to a thread stitching machine for processing signatures into book blocks, wherein the thread stitching machine includes a transport system for the signatures and a downstream installed stitching station, and the transport system includes a transporting section on which the signatures are positioned straddling and for being supplied to the stitching station. The invention additionally relates to a method for operating such a thread stitching machine.

Conventional thread stitching machines can only be set up for a single format each time, wherein this is achieved with the aid of mechanical connections, for example the use of gear clutches and magnetic brakes during the setup for the production. However, this system cannot be adjusted flexibly during the course of the production, thereby causing problems when book blocks are composed of different-size signatures, also called print sheets, for example if they are designed in this way as an art print or for other design reasons.

In particular if the signatures are to be transported with the bottom side and retrieved with the top side or if they are to be transported and transferred with the top side, this is either not possible or only with restrictions as a result of the inflexible format adjustment, wherein this results in a reduction of the production speed, a machine stop, or having to continually deposit the signatures by hand.

The placement of signatures of different sizes by hand onto a stitching stack, as is the practice at the present time, involves dangerous safety-technical sequences which are no longer tolerated by the authorities in charge of safety, owing to the fact that the machine operator is in great danger of sustaining serious injury to his/her fingers.

For safety-technical reasons alone, the use of machines with an auxiliary saddle support would therefore be preferable. The disadvantage of such machines is the constantly repeating, monotonous movement sequence for the operator when depositing the individual, manually opened signatures. The danger of mixing up signatures furthermore exists, which should not be overlooked and which can lead to a rejection rate which cannot be ignored. However, manually depositing signatures with different formats onto the auxiliary saddle is possible only if the conveying chain has no fixed position.

A different option of producing a book of this type, provided with below-standard format inserts, is to divide this book into several parts and to subsequently combine the thread-stitched parts. With this type of process, all full-format signatures which are also called standard format signatures are initially stitched together, up to the point until a below-standard format signature is reached. Subsequently, all standard format signatures that follow below-standard format signatures are processed and finally, the below-standard format signatures are stitched together. In the end, a book with at least three thread-stitched partial book blocks is produced which can subsequently be adhesive-bound in the correct sequence.

Owing to the increased demand for books of this type, for which at least one section differs for design reasons from the remaining part of the book, the standard sequences used with thread stitching machines known from the prior art are no longer sufficient since a reliable economic production can no longer be realized with any of the known techniques.

In this context and in view of the known prior art, we additionally refer to the European patent document EP 2 184 177 A1 which describes a machine for the thread stitching of folded printed products. According to this document, the individual printed products are stitched along the fold with a stitching or sewing machine and are then sewn together along the back provided with the fold, so as to form a book block, wherein the printed products are supplied to the stitching station while positioned individually and straddling on a pivoting saddle. This document forms an integral component of the specification for the present application and its disclosure is incorporated herein by reference.

SUMMARY OF THE INVENTION

It is an object of the invention to remedy the aforementioned problem.

In industry circles, thread-stitching machines of this type are nowadays also referred to as automatic thread stitching machines.

According to an embodiment, there is provided a thread stitching machine for processing of signatures into book blocks, comprising: a transport system for the signatures including a transport section on which the signatures are positioned straddling for being supplied to a stitching station, the transport section including an auxiliary saddle and at least one driven, continuously moving conveying chain to drive the auxiliary saddle, the conveying chain having spaced-apart, integrated pusher elements; a downstream installed stitching station including a freely moving stitching saddle immediately following the auxiliary saddle, the stitching saddle including a separate conveying device for the signatures, operated with the aid of a drive; and at least one detection device arranged at a transition between the auxiliary saddle and the stitching saddle to detect a local position of the signature and a point in time at which the signature passes by, wherein the conveying chain is operated with a change in speed that depends on different sheet lengths following each other directly in a sequence of signatures.

Thus, according to the invention, a signature transporting section is proposed which operates between an upstream arranged opening system and a downstream arranged stitching or sewing station. This transporting section essentially consists of an auxiliary saddle and a following stitching saddle. The auxiliary saddle and the stitching saddle are configured as autonomously operating, partial transporting sections. However, according to the invention these sections are operatively interdependent for the signature transport. This mode of operation according to the invention is per se independent of the way in which the purely "standard format" signatures are transported, or whether intermittently "below-standard format" signatures need to be processed.

The transport system can reliably supply signatures with different formats and/or different sheet lengths to the stitching station, in the correct position and without production losses within a uniform production mode.

The invention therefore provides the option of stitching below-format signatures, special types of signatures or other types of inserts to form a book or a book block without interrupting the stitching process or without having to newly combine parts of a book.

According to the invention, the following precautions are taken and/or are implemented interdependent to each other in the transport system.

The conveying chain drive, operated mechanically in the past or rigidly adjusted to a specific format during the setup with the aid of a multi-tooth clutch and a magnetic brake, is preferably replaced by an asynchronous motor that is controlled by a servo inverter. As a result, it is possible to control the conveying chain during the production so that it can respectively adjust to the sheet length of the signature currently located on the auxiliary saddle. This takes place at full production speed, thus making it possible to omit the previously used components, such as the drive, the multi-tooth clutch and the magnetic brake.

It should be mentioned that entering a predetermined sequence into a central control for processing the signatures should be given high priority. However, changes or interventions at certain points in the process can also be super-imposed on this predetermined sequence. The sequence furthermore ensures the control as well as the insertion of empty cycles needed in-between.

An additional detection mechanism can furthermore be provided on the transporting section belonging to the auxiliary saddle which triggers the following control steps:

a) if a below-standard format signature is transported, a temporary acceleration of the conveying chain is triggered;

b) following the below-standard format signature, an empty cycle is inserted in which no signature is supplied;

c) a delay in the conveying chain speed is triggered if the empty cycle is followed by a standard format signature.

The additional detection mechanism can without problem be operated separately or it can be switched redundant with the previously determined sequence for the signatures to be transported.

According to another aspect of the invention there is provided a method for operating a thread stitching machine used for the processing of signatures to form book blocks, comprising: transporting the signatures by a transport system to a downstream-connected stitching station, the transporting including; positioning the signatures straddling on a transporting section of the transport system to supply the signatures to the stitching station; and operating the transporting section with aid of (1) an auxiliary saddle driven by at least one continuously operating conveying chain with thereon positioned, spaced-apart pusher elements, and (2) a freely movable stitching saddle immediately following the auxiliary saddle; the operating step including advancing the signatures by the pusher elements pushing against one edge of the signatures, gripping the signatures along an opposite edge by a conveying device belonging to the stitching saddle and removing the signatures from the auxiliary saddle by an acceleration movement triggered by a drive associated with the conveying device of the stitching saddle.

A book to be stitched or sewn together can be composed of 10 signatures, for example, wherein for the sake of explanation we assume that there are 9 standard-format signatures, meaning they have the same format size, and one below-standard format signature, meaning it has a shorter sheet length. Given this starting situation, all signatures are supplied according to uniform principles, either with the top or bottom in the lead. If the bins are loaded individually or a manual insertion takes place, in exceptional cases, then the initially determined sequences must always be maintained strictly.

The thread stitching machine adjusts its production, meaning its cycles, to the largest format to be stitched. The system for feeding the signatures successively guides the signatures from the bin via an opening system to the auxiliary saddle, on which they are positioned straddling and where the individual signatures are picked up at the bottom side by a pusher element (pusher finger), are conveyed further until they can be gripped along the top side and taken over by a sheet-feeding system belonging to the stitching saddle. Immediately following this takeover, the signatures are transported further along the stitching saddle at maximum acceleration. To an observer it might appear that during the transfer the signatures are so-to-speak pulled or shot away from the auxiliary saddle.

This process continues unchanged until a below-standard format signature must be pulled from the bin or has been pulled from the bin. During the following sequence an empty sheet is generated, meaning an empty cycle during which no further signature is withdrawn is inserted following the below-standard format signature, so that a gap is generated in the course of the transport. This gap will be discussed further in the text below.

If the below-standard format signature is given the number 5 among the grouping of signatures, the following signature sequence results: 1, 2, 3, 4, 5, 0, 6, 7, 8, . . . , wherein 0 in this case illustrates the empty sheet or cycle. An empty sheet means that the machine does not pull a sheet from the bin, thus generating an empty space or gap in the flow of material in the machine, which gap is then recognized in the stitching center for the stitching station and is converted to an empty stitch.

Different sequences are triggered as a result of detection and/or by specifying ahead of time that a below-standard format signature is being transported and that an empty space must be inserted following this signature.

When entering the sheet-insertion system belonging to the stitching saddle, the top of a signature may be first detected with the aid of a photoelectric cell. At this point in time, the spacing between the pusher element and the sheet-insertion system corresponds precisely to the sheet length of the standard format signatures. If the sheet No. 5 having a sheet length that is shorter by $\Delta$ as compared to that of standard format signatures arrives on the auxiliary saddle for the transport, this sheet No. 5 would arrive later at the stitching saddle by an amount of in lengthwise direction, given the traditional format adjustment, and could therefore no longer be gripped on the top side and transported further. This would invariably result in a collision with the stitching saddle already moving into the stitching position, which would then result in a stop of the complete system.

The feeding system according to the invention catches these format differences through the operative connection with a central control unit, as follows:

During the transport on the auxiliary saddle, the independently driven conveying chain pushes the signature in the transporting direction forward with the aid of the associated pusher element, by a length amount of $\Delta$, wherein this is achieved with a temporary acceleration of the conveying chain. As soon as the length amount $\Delta$ is compensated for, the conveying chain again resumes the original transporting speed. This measure consequently ensures that the edge of the below-format signature which represents the top side arrives at the same time at the stitching saddle as would have been the case for the edge of the standard format signature during an earlier cycle. As a result, the detection mechanism confirms an orderly production sequence.

Thus, the sheet-insertion system of the stitching saddle can operate format-independent in that initially the front edge of the signature is detected and this is followed by a detection of the back edge, wherein the respective confirmation that the back edge of the signature has also passed the point of transition from the auxiliary saddle to the stitching saddle at the correct time is a guarantee that standard-format signatures as well as below-format signatures are supplied precisely positioned and integrally to the stitching saddle.

During the empty cycle 0 that follows the below-standard format sheet, the conveying chain once more automatically adjusts to the original length of the standard format signature with the aid of a negative acceleration (delay). The length amount Δ is compensated for as a result of the signature transport which now moves faster, thereby returning the feeding system to the initial state, relative to the full-format signatures.

In the event that several signatures 5 follow successively, the negative accelerations are initially suspended and the empty cycles 0, matching the number of successively following signatures 5, are also omitted for the time being.

If successively following below-standard format signatures have different sheet lengths, relative to each other, a production can still be continuous, provided the corresponding empty cycles are inserted in which a corresponding acceleration/delay in the conveying chain is realized, relative to the sheet lengths of the signatures. Otherwise, it is always possible to adjust the feeding system by inserting empty cycles.

The feeding system according to the invention furthermore has the following advantages:

In principle, the manual tasks carried out by the operator can be omitted completely with the subject matter of the invention and, at best, they tend toward zero. On the one hand, this ensures that the safety guidelines to prevent accidents can be observed while, on the other hand, it also guarantees that no incorrectly composed book blocks are produced as a result of inattention by the operator.

However, if the option of a manual intervention cannot be relinquished completely, it should be provided that the pusher element or elements of complementary conveying chains are protected for this purpose by profile parts, so that the machine operator cannot be caught by these pusher elements while performing the manual task.

For specific editions, it can definitely be useful if specific, below-standard format signatures can be placed manually onto the auxiliary saddle. When using this mode of operation, the pre-adjusted cycle sequence for the thread-stitching machine intervenes, meaning the machine is stopped for inserting this signature. Once the signature has been inserted, the machine resumes its original production. Since the auxiliary saddle for the thread-stitching machine can be protected sufficiently, for example by using a protective door with automatic circuit breaker and acknowledgment, the operator is not in danger at any time.

The predetermined input of the required signature sequence into the central control unit ensures that an empty cycle is again inserted following the manual insertion of a below-standard format signature, wherein the following production for the processing of standard format signatures then occurs in an orderly manner, until the next shutdown of the machine.

It is therefore possible without problem to maintain a fully automatic operation of the machine during the feeding of standard-format as well as below-standard format signatures, as described in the above, so that the machine needs to be stopped only at some points, for example for the manual insertion of a special type of signature. These sequences can advantageously also be predetermined and input at the control unit.

The herein described feeding system, in connection with a thread stitching machine, can furthermore also be used for gathering and wire-stitching machines. To be sure, these machines are not intended to produce a thread-stitched printed product composed of signatures or provided with different supplements, having different format lengths, but to transport the printed product while gripped along the bottom and then subsequently convey it further precisely positioned while gripped along the top side.

A format change can take place automatically at full machine speed during the ongoing production, regardless of whether smaller or larger formats are being processed.

BRIEF DESCRIPTION OF THE DRAWINGS

These and other features and advantages of the invention will be further understood from the following detailed description considered in conjunction with the following drawing figures. All features not essential to the direct understanding of the invention have been omitted. The same features are given the same reference numbers in the various figures.

DETAILED DESCRIPTION

Figure 1:
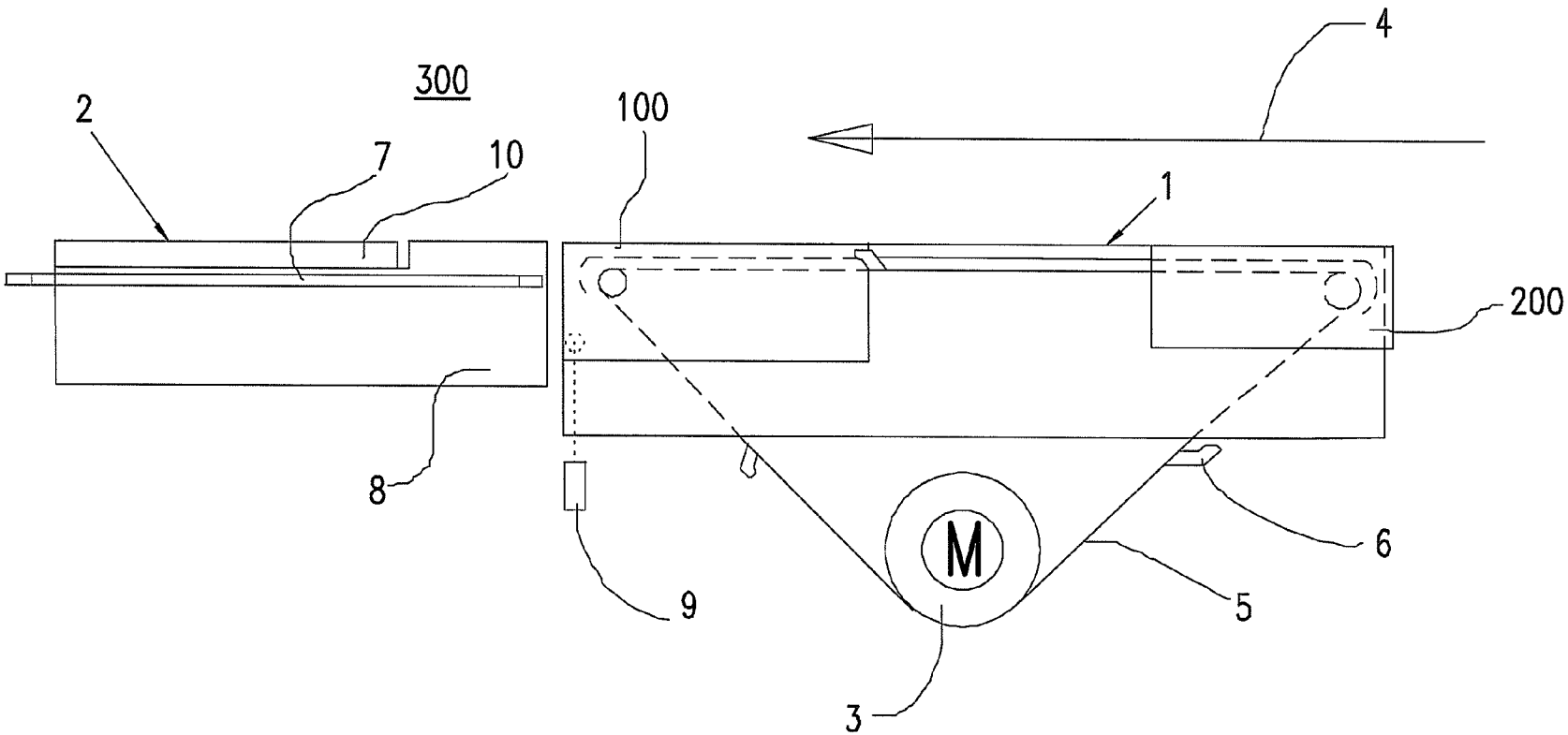
FIG. 1 is a side view showing a schematic of an auxiliary saddle and a stitching saddle which are operatively connected in the signature transporting direction, wherein a standard format signature and immediately following a below-standard format signature are positioned on the auxiliary saddle.

FIG. 1 illustrates a signature transporting section which is located between an opening system 4 that is not shown in further detail herein and a stitching station 300, also not shown in further detail herein. This transporting section consists of an auxiliary saddle 1 and a downstream arranged stitching saddle 2. The auxiliary saddle 1 and the stitching saddle 2 are per se autonomously operating partial transporting sections. Of necessity, they are also interdependent for the transport of the signatures, meaning they are operatively connected. This starting situation is per se independent of the operating sequence, meaning whether "standard-format" signatures 100 or intermittently transporting "below-standard format" signatures 200 are being transported.

The selected terminology with respect to "standard-format" and "below-standard format" does not mean anything other than that the standard format signatures have a uniform dimensioning which determines the actual size of the book block. The below-standard format signatures are dimensioned smaller, relative to the standard format signatures. In principle, the below-standard format signatures can deviate with respect to the sheet length as well as the sheet width, wherein the sheet width in this case is not important for the transport according to the invention.

The object above all is therefore the continuous processing of signatures having different sheet lengths, wherein these generally come up intermittently, without having to stop the transport system each time or take other measures. For the present transporting system, the cadence used is therefore not important and also not the intermittent mode at which the different signatures follow each other. The below-standard format signatures can therefore in principle be distributed throughout the complete book or can form a cohesive packet.

FIG. 1 illustrates what is important when transporting signatures that are positioned straddling and have different sheet lengths. Above all, FIG. 1 shows that the auxiliary saddle 1 uses an autonomous mode for conveying the signatures 100, 200 which permanently ensures the continued conveying in the correct position with the aid of a motor with rotary position transducer, sprocket 3 and chain 5. The initial transport of a signature 100, 200 arriving from an opening system 4, not shown in further detail herein, occurs initially via a conveyor belt that is also not shown in detail and which grips the signature frictionally and continues to convey the signature. Once the signature has been advanced over at least its total sheet length along the auxiliary saddle, the circulating conveying chain 5 that is driven by the aforementioned motor 3 intervenes for the further and position-stable conveying of the signature, wherein this chain is provided with spaced-apart pusher elements 6, also called pusher fingers.

Owing to the fact that the signatures are positioned straddling on the auxiliary saddle, they can be gripped easily by the pusher elements 6 since each pusher element 6 only needs to grip one signature per se along the side and below the sheet back. The pusher element 6 thus advances the signature, gripped on the bottom, in a timed manner along the auxiliary saddle 1 and in the direction toward the stitching saddle 2.

For this, FIG. 1 shows a snapshot of the standard format signature 100 being conveyed along which is positioned at the end of the auxiliary saddle 1 and/or directly in front of the stitching saddle 2. In this position, the signature 100 is located at the start of a sheet-insertion system 7 that belongs to the stitching saddle 2. The signature 100 is therefore initially pushed by the pusher element 6 in the direction of the sheet-insertion system 7 where it is taken over while gripped along the top by the sheet-insertion system 7 and is then conveyed further. During this transporting sequence which is realized with the sheet-insertion system 7, the stitching saddle 2 is in the loading position.

It should be noted here that the stitching saddle 2 is provided with a preliminary saddle section 8, arranged on the underside, which basically carries out the vertical movement of the stitching saddle 2. The final, pivoting movement of the stitching saddle 2 with thereon positioned signature toward the stitching station 300, which is not shown further herein, is generally realized with an upper part 10 that belongs to the stitching saddle. That is to say, starting with its loading position the stitching saddle 2 executes a vertical/pivoting movement to deliver the signature to the stitching station 300.

FIG. 1 furthermore shows that the following signature 200, which arrives from the opening system 4 and has a below-standard format sheet length, has already reached the auxiliary saddle 1, wherein this signature 200 is gripped in the same way as the preceding standard format signature 100 by the next pusher element 6 and is transported forward. However, the preceding standard format signature 100 must first be transferred with synchronous timing to the stitching saddle 2.

A photoelectric cell 9 for realizing a control function is therefore provided for this purpose at the end of the auxiliary saddle, such that initially the front edge of the signature 100 is detected to determine whether this edge is positioned at the correct point in time at the correct location with respect to the timing. If the detection confirms that both parameters have been observed, the signature 100 can be transferred in an orderly manner to the stitching saddle 2 in the loading position. The signature 100 which is gripped along the top by the sheet-insertion system 7 is then pulled or shot onto the stitching saddle 2 with the aid of a strong acceleration and is then conveyed to an end region from which the signature is supplied to the stitching station 300. The same photoelectric cell also continuously detects whether the bottom edge of the signature 100 has actually passed the location while synchronized with the clocking rate, something that will be discussed further with regard to FIG. 2.

The herein provided example according to FIG. 1 is based on the assumption that the signatures 100, 200 are advanced with the bottom side along the auxiliary saddle by the pusher elements 6 and are then gripped on the top by the sheet-insertion system 7 of the stitching saddle 2. A position specification of this type, however, should not be considered imperative because the signatures can also be supplied by the opening system 4 while turned by 180°. In that case, the pusher elements 6 would grip the signatures along the top to push these along the auxiliary saddle 2 and, of course, the signatures would consequently be gripped along the bottom by the sheet-insertion system 7 to be conveyed further along the stitching saddle.

Figure 2:
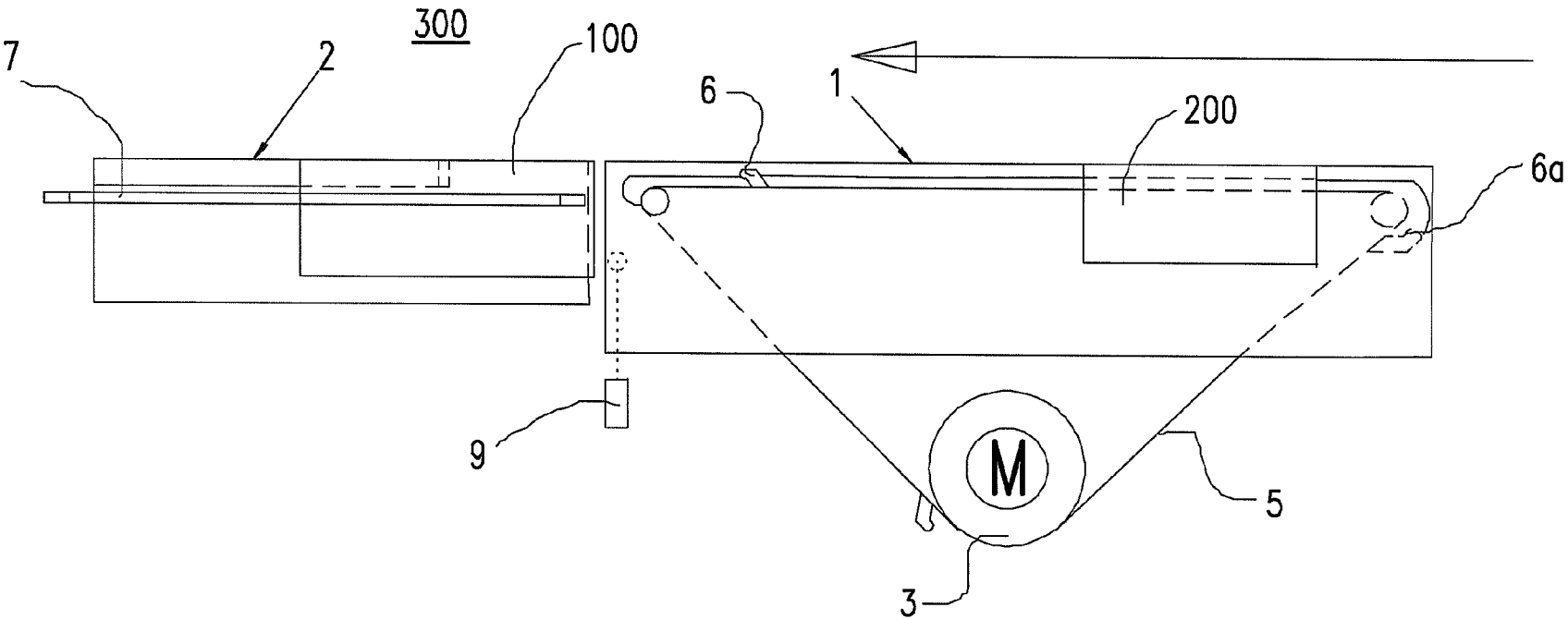
FIG. 2 is a similar view as in FIG. 1, showing a transport situation in which the standard format signature is positioned on the stitching saddle while the below-standard format signature is transported on the auxiliary saddle.

FIG. 2 shows that the standard format signature 100 is positioned completely on the stitching saddle 2. As soon as this signature 100 is gripped by the sheet-insertion system 7, it is accelerated strongly by this system during a first transporting phase, so that it is pulled or shot, so-to-speak, from the auxiliary saddle 1 and onto the stitching saddle 2. That also follows from FIG. 2 itself which shows that the original pusher element 6 for this signature is still located in the region of transport along the auxiliary saddle 1 while the signature is already positioned fully on the stitching saddle 2 because of the acceleration injected by the sheet-insertion system 7.

During this transient course for transporting the signature 100, the photoelectric cell 9 already mentioned in connection with FIG. 1 detects whether the signature 100 has completely left the auxiliary saddle 1. That is to say, the function of the photoelectric cell 9 initially is to ensure that the subsequent, pre-programmed movement of the stitching saddle 2 toward the stitching station 300 occurs at the correct clocking rate. The detection by the photoelectric cell 9 furthermore ensures that a program influences the transport of the below-standard format signatures 200 on the auxiliary saddle 1 as follows.

Since the below-standard format signature 200 is shorter in length by Δ than the standard format signature 100, the following pusher element **6*a* is positioned too far by the aforementioned amount from the below-standard format signature 200 because this pusher element 6*a* is still adjusted to the standard format of the preceding signature 100. To allow the pusher element 6*a* to catch up with the below-standard format signature 200 that is running ahead, the signal emitted by the photoelectric cell 9 also ensures that the conveying chain 5 is accelerated accordingly by the motor 3, which preferably can also be an asynchronous motor, meaning that the distance amount Δ is compensated for through a temporary acceleration relative to the machine speed. As a result, the below-standard format signature 200 positioned on the auxiliary saddle 1 is moved ahead further by an additional distance Δ in the direction of the sheet-insertion system 7, wherein this distance Δ corresponds to the difference in the sheet length between the two signatures 100 and 200. The position of the below-standard format signature 200 is thus on the whole moved ahead by a distance Δ that represents the difference between the two signatures 100 and 200**.

Figure 3:
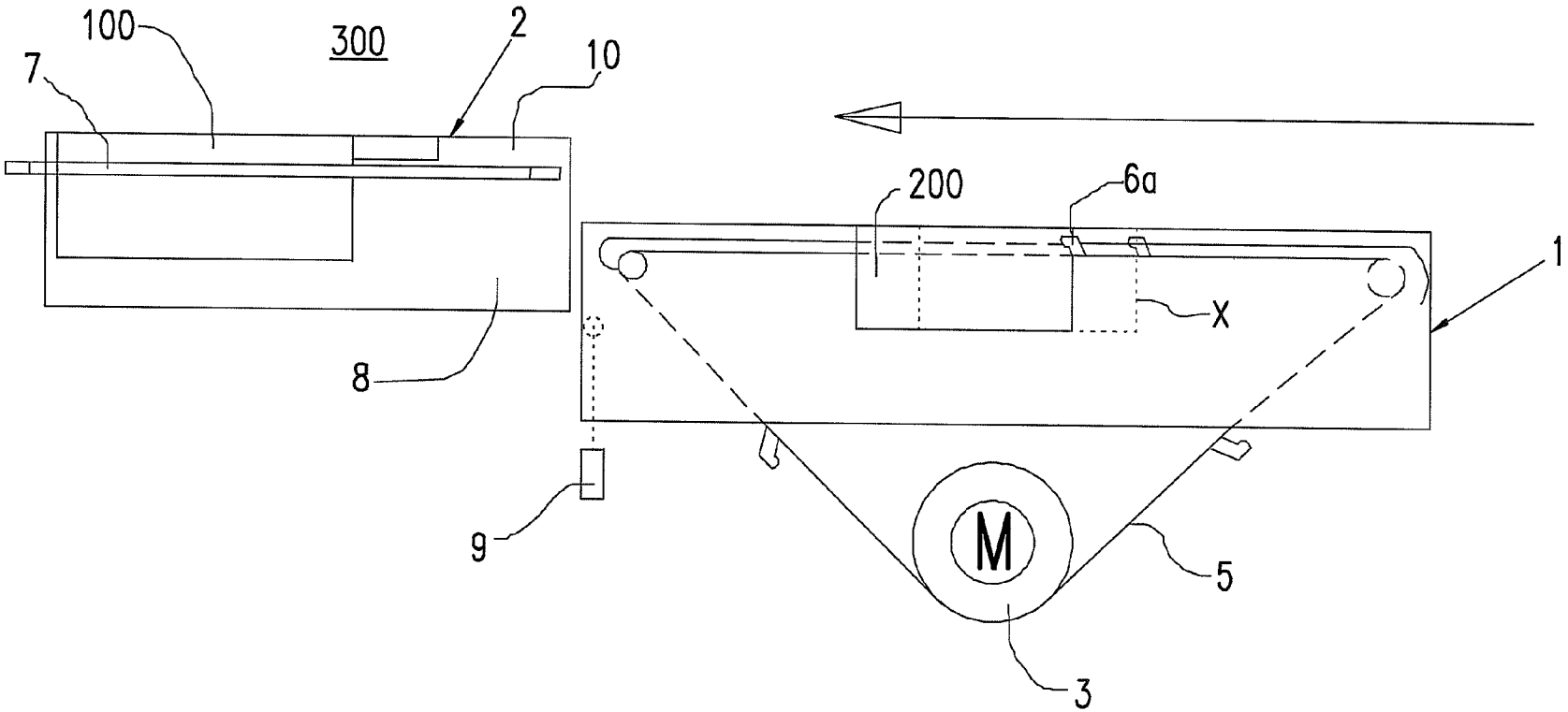
FIG. 3 is a similar view as in FIG. 1 showing a following, additional transport situation in which the standard format signature has reached the end position on the stitching saddle while the below-standard format signature experiences an acceleration phase on the auxiliary saddle, meaning the stitching saddle is in the process of entering the stitching position.

FIG. 3 shows the dynamics described in connection with FIG. 2 and the handling of the transport of a below-standard format signature 200. As a result of the acceleration transmitted by the motor 3 to the conveying chain 5, the pusher element 6*a* makes up the difference Δ in the sheet length and then continues to move with the original machine speed. This temporary acceleration thus achieves that the pusher elements 6*a* can purposely catch up with the below-standard format signature 200. The dashed line X indicates where the below-standard format signature 200 would be located without the acceleration.

FIG. 3 simultaneously also illustrates that during this acceleration phase and/or at the conclusion of this phase, the stitching saddle 2 is moved integrally, meaning together with all its elements, with the aid of a vertical/pivoting movement to the stitching station 300. It is clearly demonstrated here which eminently important function the photoelectric cell 9 meets for the complete transporting process since the stitching saddle 2 is only released for operation by the photoelectric cell 9 if the bottom edge of the respective signature has been pushed completely onto the stitching saddle 2.

The acceleration triggered by the sheet-insertion system 7 and acting upon the signatures is preferably realized with a drive that is not shown further herein and which, following the gripping of the signature, immediately changes to the maximum acceleration. At the end of the transporting section on the stitching saddle 2 the speed is delayed, so that the edges of the transported signatures do not impact too violently with an end stop provided thereon. This end stop functions to align all arriving signatures along the top side before these signatures are supplied to the stitching station 300. If small differences can be tolerated during the alignment of the signatures, it is also possible to operate without an end stop, which can advantageously be taken into consideration for signatures composed of thin paper.

If the alignment along the top of the below-standard format signatures does not coincide with the alignment of the remaining standard format signatures, for example in cases where the below-standard format signatures are aligned along the bottom or placed in-between, an alignment is still possible solely by controlling the drive or displacing the end stop individually by the corresponding amount, so that the below-standard format signatures can reach the specified position. It is also possible to stipulate an inter-dependent coordination between the drive and the end stop.

Figure 4:
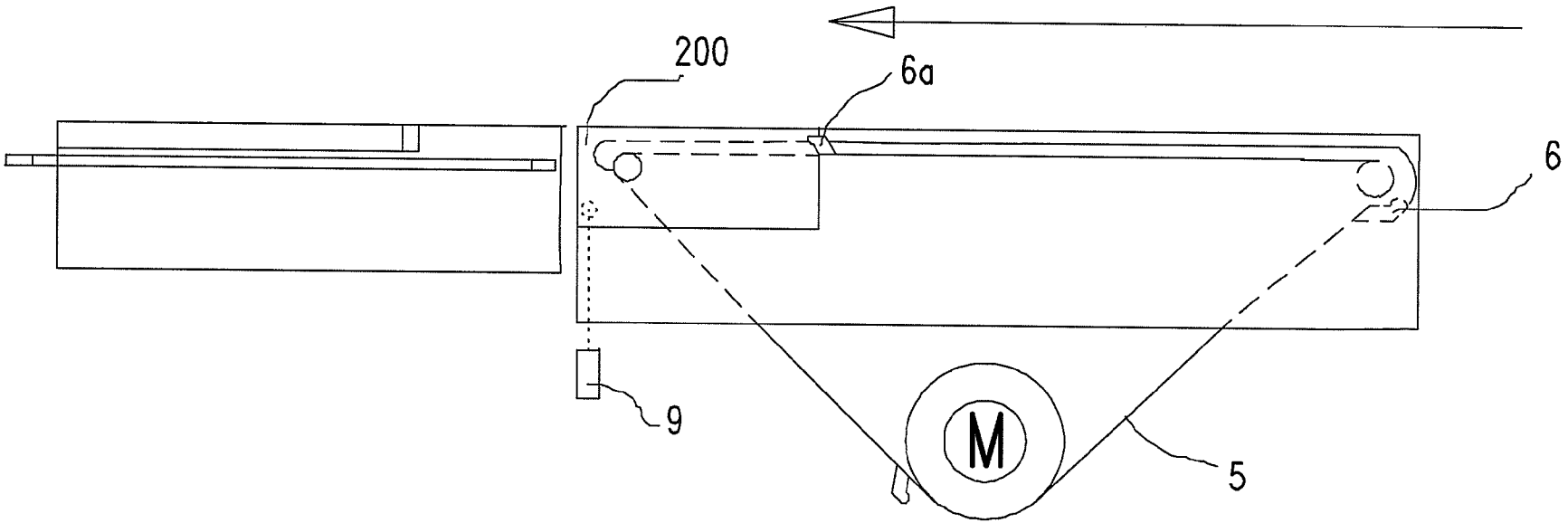
FIG. 4 is a similar view as in FIG. 1 showing yet another transport situation, in which the below-standard format signature has reached the end of the auxiliary saddle and the stitching saddle has once more assumed its original loading position.

FIG. 4 shows the situation during the transport where the below-standard format signature 200 is located at the same moment at the intake of the sheet-insertion system as was the case during the previous cycle for the standard format signature 100, owing to the acceleration of the conveying chain as described in connection with the preceding Figures. The same detection criteria can therefore be used by the photoelectric cell 9 for detecting the top edge of the below-standard format signature. Immediately following a below-standard format signature 200, an empty cycle is inserted, meaning no new signature follows directly after the last-mentioned signature. In contrast to FIG. 1 where a new signature has already been supplied, the following pusher element 6 consequently also does not supply a new signature.

Figure 5:
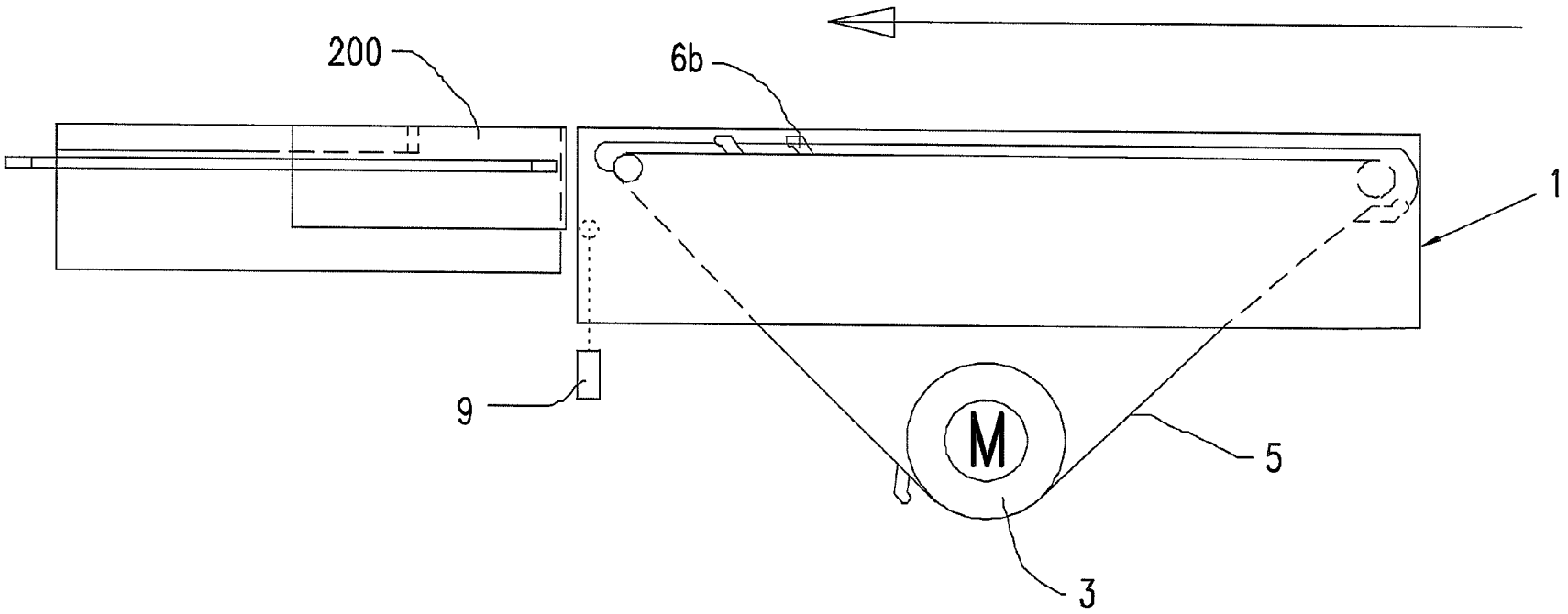
FIG. 5 is a similar view as in FIG. 1 showing a further transport situation where the below-standard format signature has been transferred to the stitching saddle, wherein the following sequence consists of the stitching saddle again moving as shown in FIG. 3 as soon as the below-standard format signature has reached the end position on the stitching saddle.

FIG. 5 shows the situation indicated in FIG. 4 in connection with the previously addressed empty cycle. As soon as the below-standard format signature 200 has left the operating range of the auxiliary saddle 1 and this has been confirmed by the photoelectric cell 9, the motor 3 will delay the conveying chain 5. As a result, the machine again catches up with the chain and/or the pusher element 6*b* which is now moving empty, thereby compensating for the difference in the sheet length between the below-standard format signature 200, just transported, and a following, standard format signature 100.

A collision with subsequently arriving signatures does not occur since no signature is positioned at this point in time on the auxiliary saddle 1 because of the inserted empty cycle. Following the conclusion of this speed adaptation, the system again assumes the starting state, meaning the standard format signatures can again be conveyed monotonously.

The system is also suitable for equipping the auxiliary saddle 1 with two independently operating conveying chains, wherein the one conveying chain is used exclusively for conveying standard format signatures while the additionally provided conveying chain transports specifically the below-standard format signatures and, consequently, intervenes only if below-standard format signatures are to be conveyed. Of course, the first conveying chain in that case should operate with the same timing as the second conveying chain so that the stitching saddle is not overtaxed by an excessively fast delivery of signatures.

It will be understood that the above description of the present invention is susceptible to various modifications, changes and adaptations, and the same are intended to be comprehended within the meaning and range of equivalents of the appended claims.

What is claimed is:

1. A method for operating a thread stitching machine used for the processing of signatures to form book blocks, comprising:

transporting the signatures by a transport system to a downstream-connected stitching station, the transporting including;

positioning the signatures straddling on a transporting section of the transport system to supply the signatures to the stitching station; and operating the transporting section with aid of (1) an auxiliary saddle driven by at least one continuously operating conveying chain with thereon positioned, spaced-apart pusher elements, and (2) a freely movable stitching saddle immediately following the auxiliary saddle;

the operating step including advancing the signatures by the pusher elements pushing against one edge of the signatures, gripping the signatures along an opposite edge by a conveying device belonging to the stitching saddle, removing the signatures from the auxiliary saddle by an acceleration movement triggered by a drive associated with the conveying device of the stitching saddle, and inserting at least one empty cycle following a below-standard format signature.

2. The method according to claim 1, including subjecting the conveying chain to at least one speed change in dependence on a sequence of the signatures with different formats, wherein the subjecting step includes accelerating the signature speed, transported along the auxiliary saddle, and then delaying the speed once the transport of a standard format signature resumes.

3. The method according to claim 2, wherein the delaying of the speed includes delaying the conveying chain during the transport of the standard format signature on the auxiliary saddle after the empty cycle.

4. The method according to claim 2, including detecting, at a point of transition between the auxiliary saddle and the stitching saddle, a local position of the signature and a point in time at which the signature passes by using a detector mechanism that emits signals representative of the local position and said point in time; and using said signals to influence operation of the thread stitching machine.

5. The method according to claim 4, wherein the using step includes using the signals for one of confirming a continuous operation of the thread stitching machine or triggering a stop of the thread stitching machine in case of an interruption during transport of the signatures.

6. The method according to claim 2, including detecting, at a point of transition between the auxiliary saddle and the stitching saddle, a local position of the signature and a point in time at which the signature passes by using a detector mechanism that emits signals representative of the local position and said point in time; configuring the acceleration and the delay in the conveying chain speed such that differences in sheet length between a standard-format and a below-standard format signature or between a below-standard format and a standard format signature are compensated for while the signature travels the distance along the auxiliary saddle, such that at least a back edge of the signature as seen in a conveying direction passes the transition point between the auxiliary saddle and the stitching saddle with a correct timing, relative to a predetermined cycle for the stitching saddle.

7. The method according to claim 6, including inserting at least one empty cycle following each transport of a below-standard format signature along the auxiliary saddle before arrival of a following standard format signature.

8. The method according to claim 1, including positioning the below-standard format signatures with respect to the standard format signatures, so that the below-standard format signatures are aligned either flush along the top, flush along the bottom, or between the top and bottom of a standard format signature.

9. The method according to claim 1, wherein the operating step includes operating the auxiliary saddle with aid of two conveying chains, and using the first conveying chain for transporting the standard format signatures and the second conveying chain for transporting the below-standard format signatures.

10. The method according to claim 1, including stopping the thread stitching machine following a predetermined control sequence with a manual placement of a signature on the auxiliary saddle, and starting up again the thread stitching machine once an operator has completed the operation.

11. A method for operating a thread stitching machine used for the processing of signatures to form book blocks, comprising:

transporting the signatures by a transport system to a downstream-connected stitching station, the transporting including:

positioning the signatures straddling on a transporting section of the transport system to supply the signatures to the stitching station;

operating the transporting section with aid of (1) an auxiliary saddle driven by at least one continuously operating conveying chain with thereon positioned, spaced-apart pusher elements, and (2) a freely movable stitching saddle immediately following the auxiliary saddle;

the operating step including advancing the signatures by the pusher elements pushing against one edge of the signatures, gripping the signatures along an opposite edge by a conveying device belonging to the stitching saddle and removing the signatures from the auxiliary saddle by an acceleration movement triggered by a drive associated with the conveying device of the stitching saddle; and controlling the auxiliary saddle to effect the following actions:

a) triggering a temporary acceleration of the conveying chain when a below-standard format signature is transported;

b) inserting an empty cycle during which no signature is delivered, following the below-standard format signature; and c) triggering a delay in the conveying chain if the empty cycle is followed by a standard format signature.

* * * * *